US007172507B2

(12) United States Patent
Fujimoto et al.

(10) Patent No.: US 7,172,507 B2
(45) Date of Patent: Feb. 6, 2007

(54) CARD GAME MONITORING SYSTEM, CARD GAME TABLE AND MONITORING METHOD

(75) Inventors: Jun Fujimoto, Tokyo (JP); Nobuyuki Nonaka, Tokyo (JP)

(73) Assignees: Aruze Corporation, Tokyo (JP); Seta Corporation, Tokyo (JP)

( * ) Notice: Subject to any disclaimer, the term of this patent is extended or adjusted under 35 U.S.C. 154(b) by 578 days.

(21) Appl. No.: 10/235,949

(22) Filed: Sep. 6, 2002

(65) Prior Publication Data

US 2003/0064775 A1 Apr. 3, 2003

(30) Foreign Application Priority Data

Sep. 7, 2001 (JP) ..... 2001-271495

(51) Int. Cl.
*A63F 9/24* (2006.01)

(52) U.S. Cl. ..... 463/29

(58) Field of Classification Search ..... 463/29
See application file for complete search history.

(56) References Cited

U.S. PATENT DOCUMENTS 5,581,257 A * 12/1996 Greene et al. ..... 342/51
5,735,742 A 4/1998 French
5,831,527 A * 11/1998 Jones et al. ..... 340/540
5,941,769 A * 8/1999 Order ..... 463/12
6,126,166 A * 10/2000 Lorson et al. ..... 273/148 R
6,154,131 A * 11/2000 Jones et al. ..... 340/540
6,186,895 B1 * 2/2001 Oliver ..... 463/25
6,254,002 B1 * 7/2001 Litman ..... 235/450
6,460,848 B1 * 10/2002 Soltys et al. ..... 273/149 R
6,676,517 B2 * 1/2004 Beavers ..... 463/25
6,685,568 B2 * 2/2004 Soltys et al. ..... 463/47
6,753,830 B2 * 6/2004 Gelbman ..... 345/55

(Continued)

FOREIGN PATENT DOCUMENTS

WO WO 00/22585 4/2000

(Continued)

OTHER PUBLICATIONS

Lee, Y. "RFID Coil Design", 1998, Microchip Technology Inc., pp. 1-21.*

*Primary Examiner*—Corbett B. Coburn
(74) *Attorney, Agent, or Firm*—Leydig, Voit & Mayer, Ltd.

(57) ABSTRACT

To reduce monitoring staff and reduce cost by automating monitoring, a card game monitoring system includes a wirelessly communicating, identifying information recording device embedded in a card for recording information for identifying itself; identifying information reading devices provided at a card takeout slot of a card distributor in contact with the card at the start of a game and in card distribution areas of a card game table in contact with the card in the middle of the game, for reading by wireless communication the identifying information; a control device for monitoring consistency between the identifying information read with the identifying information reading device at the start of the game and the identifying information read likewise in the middle of the game by comparing both pieces of the identifying information; a notifying lamp for issuing a notice of information inconsistency, if any; a recording device for recording identifying information and results of monitoring; and an invalidating device for invalidating the identifying information of retrieved cards.

9 Claims, 3 Drawing Sheets

U.S. PATENT DOCUMENTS

| | | | | |
|---|---|---|---|---|
| 6,834,251 | B1 * | 12/2004 | Fletcher | 702/150 |
| 2002/0042298 | A1 * | 4/2002 | Soltys et al. | 463/29 |
| 2002/0068635 | A1 * | 6/2002 | Hill | 463/47 |
| 2002/0147042 | A1 * | 10/2002 | Vuong et al. | 463/40 |

FOREIGN PATENT DOCUMENTS

| | | |
|---|---|---|
| WO | WO 00/62880 | 10/2000 |

* cited by examiner

CARD GAME MONITORING SYSTEM, CARD GAME TABLE AND MONITORING METHOD

BACKGROUND OF THE INVENTION

1. Field of the Invention

The present invention relates to a card game monitoring system, a card game table and a card game monitoring method to prevent cards from being lost or replaced during games played using a large number of cards.

2. Description of the Related Art

Various card games are popular in general. In casinos or the like for example, card games are played by a dealer and plural players around a table. Card games such as "black jack," etc. are played with cards distributed on the table. When people play against each other in such a game, mistakes often occur. For example, cards used in games may go astray or wrong cards may mix in. Such errors may be caused intentionally by dealers or players.

To assure fair games by preventing such errors and wrongful acts, monitoring staff is deployed. The monitoring staff members monitor so that games are played appropriately.

However, deployment of monitoring staff members results in an increase in personnel expenses. On the other hand, wrongful acts may be perpetrated by dealers in collusion with players. While increasing the number of monitoring staff members may be conceivable to prevent such a situation by having the staff members monitor each other, such a measure would further increase personnel expenses and result in poor profitability in running casinos or the like.

The present invention has been devised in view of the above-mentioned points with an object of providing a card game monitoring system, a card game table, and a card game monitoring method intended to reduce costs by automating the monitoring.

SUMMARY OF THE INVENTION

A card game monitoring system related to the present invention comprises: a wirelessly communicable, identifying information recording means embedded in a card for recording at least information for identifying a self; an identifying information reading means, provided in a part in contact with the card at least at the start and in the middle of a game, for reading by wireless communication the information recorded in the identifying information recording means; and a control means for monitoring consistency between the identifying information read at the start of the game and the identifying information read with the identifying information reading means in the middle of the game by comparing both pieces of the identifying information.

Typically, respective cards have their specific pieces of identifying information recorded on them. When the cards are brought into a game, the information recorded on the identifying information recording means of the respective cards is read with the identifying information reading means. Next, while the game is being played, the information recorded on the identifying information recording means of the respective cards is read with the identifying information reading means. The two pieces of information read at the two time points described above are then compared with each other using the control means to monitor their consistency. In the case the comparison using the control means proves any inconsistency of the respective pieces of information, it is assumed that the inconsistency is due to missing card, mixing up or replacement with cards that are different from those used from the start of the game, and a monitoring station or a dealer is notified of such inconsistency. Incidentally, the phrase 'while the game is being played' or 'in the middle of the game' means the time duration from the start of a game to the retrieval of the cards after the end of the game. The identifying information of the cards actually used in the game is verified any time during that period of time.

In the above game monitoring system, the part where the identifying information reading means is provided and the card comes into contact with at the start of the game is preferably the card takeout slot of the card distributor. The part where the identifying information reading means is provided and the card comes into contact with in the middle of the game is preferably the card distribution area of the table.

With the above constitution, typically the identifying information reading means provided at the card takeout slot of the card distributor reads the identifying information recorded on the identifying information recording means of the card brought into the game. In this way, the cards to be used in the game are verified. Next the identifying information reading means provided in the card distribution area of the table reads the identifying information recorded on the identifying information recording means of the card being used in the game. In this way, the cards being actually used in the game are verified. The two pieces of identifying information are compared by means of the control means to monitor consistency between the two. In the case of any inconsistency, it is judged that loss of cards or the like has occurred.

It is preferable to provide a notifying means for issuing a notice of inconsistency if the inconsistency is found by comparing the two pieces of information using the control means.

With the above constitution, the staff members in the monitoring station or the dealers can learn immediately the loss of cards or the like through the notice issued from the notifying means, so that appropriate measures can be taken, such as suspending the game or the like.

It is also preferable to provide an invalidating means for invalidating information recorded on the identifying information recording means when the cards are retrieved.

With the above constitution, since information recorded on the identifying information recording means of a card is invalidated and the card is retrieved, any card after the retrieval that has mixed in the cards being used in a game can be immediately found. In this way, retrieved cards are prevented from being used by mistake. As a result, wrong cards are prevented from mixing in any time from the start of the game to the retrieval of the cards after the end of the game.

It is also preferable to provide a recording means for recording the identifying information read with the identifying information reading means and the results of monitoring with the control means.

With the above constitution, the results of comparison of the identifying information and the results of games can be accumulated in the recording means and arranged as a database. In this way, wrong acts may be discovered retroactively by checking accumulated results at a later time. That is to say, in the case any doubt about a specific game of a specific date arises at a later time, wrong acts may be discovered retroactively by reviewing the data of the day's game results or the like.

A card game table related to the present invention is a table in which the above-described card game monitoring system is installed for playing games. Cards are distributed and placed on the table to play games.

With the above constitution, in the case cards are lost, mixed in, or replaced during a card game played on the table, the loss of cards or the like is reliably detected with the card game monitoring system.

The basic Japanese Patent Application No. 2001-271495 filed on Sep. 7, 2001 is hereby incorporated in its entirety by reference into the present application.

The present invention will become more fully understood from the detailed description given hereinbelow. However, the detailed description and the specific embodiment are illustrated of desired embodiments of the present invention and are described only for the purpose of explanation. Various changes and modifications will be apparent to those ordinary skilled in the art on the basis of the detailed description.

The applicant has no intention to give to public any disclosed embodiment. Among the disclosed changes and modifications, those which may not literally fall within the scope of the patent claims constitute, therefore, a part of the present invention in the sense of doctrine of equivalents.

DESCRIPTION OF THE PREFERRED EMBODIMENTS

Details of the card game monitoring system and the card game table related to the present invention are described below in reference to the accompanying drawings. The term 'game' as used herein refers to any game played with plural cards. In the following description, the card game monitoring system is assumed to be built in the card game table.

Figure 1:
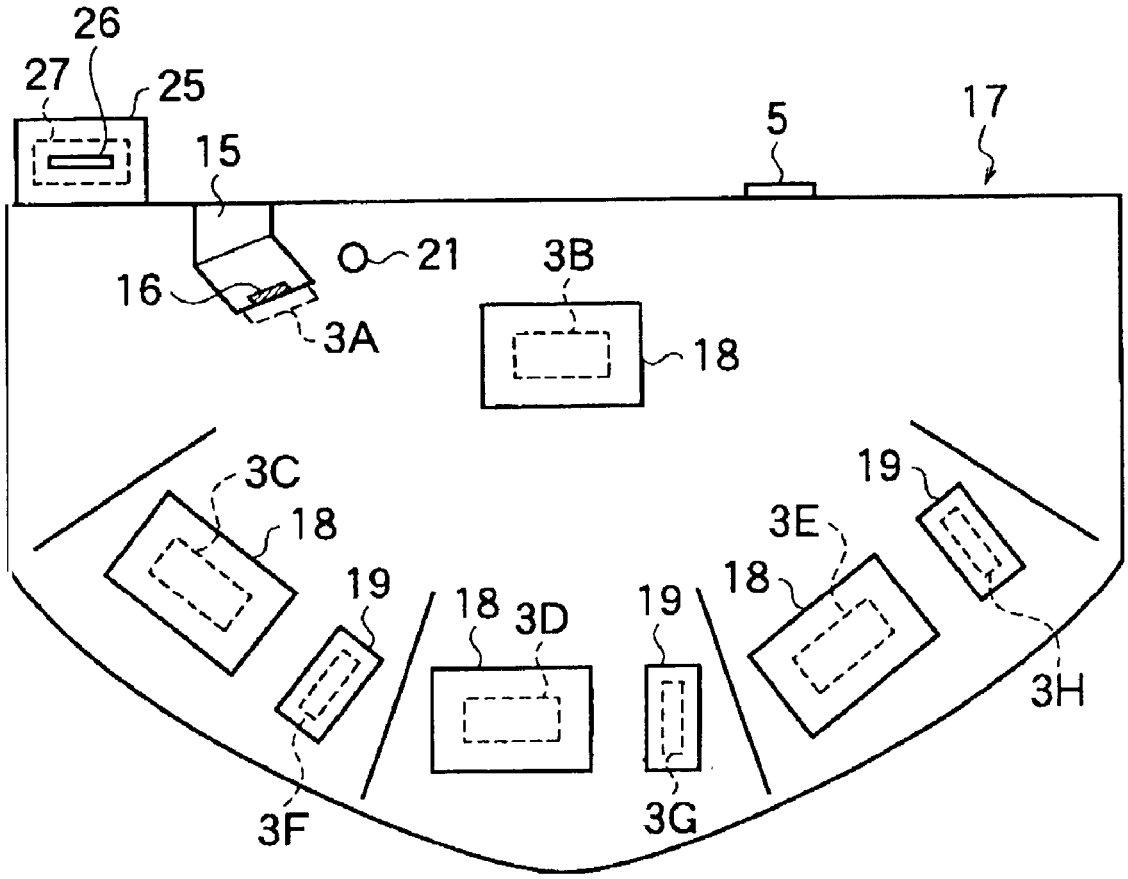
FIG. 1 is a plan view of a card game table according to the embodiment of the present invention.
Figure 2:
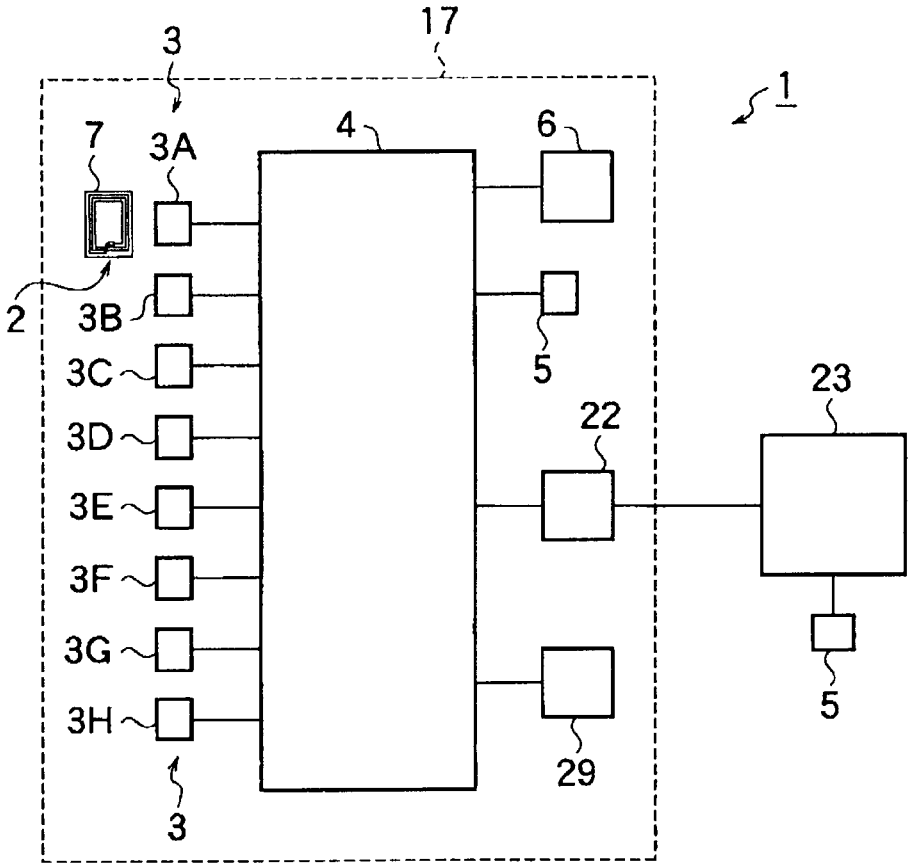
FIG. 2 is a schematic diagram of a card game monitoring system according to the embodiment of the present invention.
Figure 3:
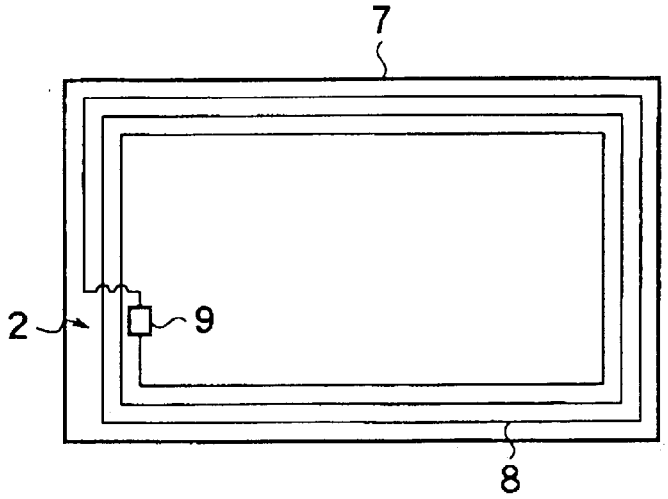
FIG. 3 is a plan view of an identifying information recording device embedded in a card according to the embodiment of the present invention.
Figure 4:
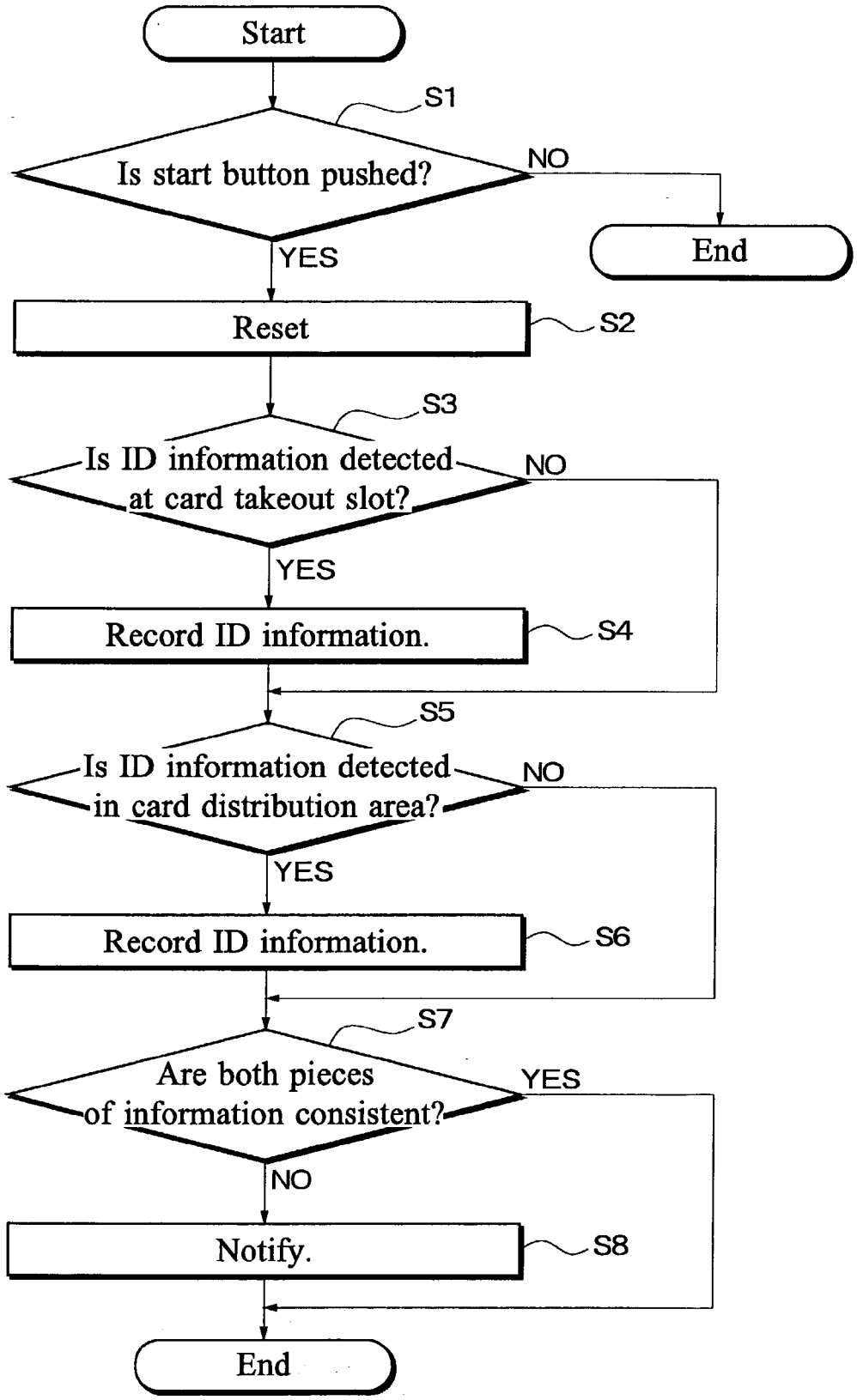
FIG. 4 is a functional flowchart of a control device according to the embodiment of the present invention.

FIG. 1 is a plan view of a card game table. FIG. 2 is a schematic diagram of a card game monitoring system. FIG. 3 is a plan view of an identifying information recording device embedded in a card. FIG. 4 is a functional flowchart of a control device.

The card game monitoring system 1 is used to monitor whether the cards are lost, wrong cards mix with the cards being used from the start of the game, or the cards are replaced with wrong cards, while the card game is being played. The card game monitoring system 1 is constituted as shown in FIG. 2 mainly with an identifying information recording device 2, an identifying information reading device 3, a control device 4, a notifying lamp 5, and a recording device 6.

The identifying information recording device 2 as shown in FIG. 3 is an identifying information recording means embedded in a card 7 to record various pieces of information. Information to be recorded includes information for identifying a self, in the case of a card game for example, at least respective numerals of the cards and information to the effect that the cards belong to a group (group used in a game). Besides, other pieces of information such as date, place, etc. may be appropriately recorded as required. The identifying information recording device 2 is provided with a wireless communication function. To put it more specifically, it is provided with an antenna coil 8, an IC chip 9, a tuning capacitor, a rectifying diode, and a smoothing capacitor. Incidentally in the FIG, the tuning capacitor, the rectifying diode, and the smoothing capacitor are installed within the IC chip 9. The antenna coil 8 and the tuning capacitor constitute a resonance circuit.

The antenna coil 8 is wound several turns annularly along the marginal region of the card 7. The antenna coil 8 is made by etching a copper foil or the like, so that deflection of the card 7 is allowed and that the thickness of the card 7 is not affected. The IC chip 9 is connected to both ends of the antenna coil 8. The antenna coil 8 is adapted to its required function by appropriately setting its number of turns, the copper wire-to-wire intervals, etc. The antenna coil 8 is made to perform non-contact information transmission using magnetic field induced by mutual induction as a transmission medium. The maximum distance over which information can be transmitted between the information recording device 2 and the identifying information reading device 3 is usually about several centimeters. Therefore, the identifying information reading device 3 is positioned to be capable of contacting the card 7 within the distance of several centimeters, which will be described later in more detail.

The identifying information recording device 2 of the above-described constitution is also built in chips (not shown), which stores mainly information on amounts.

The identifying information reading device 3 is a means for reading information recorded on the identifying information recording device 2. The identifying information reading device 3 reads the above-mentioned information at least when the cards 7 are brought into games and during the games. All the cards 7 to be used in a game are recognized as the above-mentioned information is read when the cards 7 are brought into the game. All the cards 7 being actually used in the game are recognized as the above-mentioned information is read during the games. The identifying information reading device 3 comprises a transmitter-receiver (not shown) that performs non-contact information transmission using induction magnetic field as a transmission medium to and from the antenna coil 8. The transmitter-receiver performs non-contact information transmission to and from the antenna coil 8 using magnetic field induced by mutual induction as a transmission medium. The identifying information reading devices 3 are provided at a card takeout slot 16 of a card distributor 15 and in a card distribution area 18 of a card game table 17, which will be described later.

The card distributor 15 is a container for holding the cards 7 and taking out the cards one by one. If necessary, the function of shuffling the cards 7 is provided. The card takeout slot 16 is provided as shown in FIG. 1 on the front face of the card distributor 15, through which the cards 7 may be taken out one by one. An identifying information reading device 3A is provided in a position facing the card takeout slot 16. The identifying information reading device 3A is provided in that position because the card takeout slot 16 is the place that inevitably comes into contact with a card 7 when it is taken out. In the case the card distributor 15 is fixed to the game card table 17, the identifying information reading device 3A is attached to a position facing the card takeout slot 16 in the card distributor 15, or to a position in the game card table 17 facing the card takeout slot 16. In the case the card distributor 15 is not fixed to the game card table 17, the identifying information reading device 3A is attached to a position facing the card takeout slot 16 in the card distributor 15. In this way, it is arranged that the identifying information reading device 3 may come into contact with the cards 7 taken out of the card takeout slot 16 within a distance of several centimeters (communicable distance). All the cards 7 from which information is read with the identifying information reading device 3A must be in use during games thereafter.

The form of the card game table 17 in plan view is straight on its dealer side and curved on its players side. Accordingly, games are played with three players sitting along the curved, players side, and a dealer sitting on the straight side of the card game table 17. The top surface of the card game table 17 has four card distribution areas 18, one in front of the dealer and three in front of respective players, on which cards 7 are placed as distributed during games. The right hand side of the card distribution area 18 in front of each player is provided with a stake area 19 for placing chips. Each of the four card distribution areas 18 and the three stake areas 19 is provided with the identifying information reading device 3. Each of the individual identifying information reading devices 3B to 3H is embedded in the card game table 17, so that it comes into contact with the cards 7 and the chips within the distance of several centimeters (communicable distance). All the cards 7 in the respective areas from which the information is read with individual identifying information reading devices 3B to 3H must be those taken out of the card takeout slot 16.

The control device 4 is a control means for monitoring the consistency of two pieces of information, one read at the start of a game and the other during the game, using the identifying information reading device 3. As shown in FIG. 2. the identifying information reading devices 3A to 3H, the notifying lamp 5 on the card game table 17 side, the notifying lamp 5 on the monitoring station side, and a display device 29 are connected to the control device 4. The control device 4 comprises a CPU, a ROM, a RAM, etc. to have functions shown in the flowchart of FIG. 4. The information on the results of comparatively monitoring the identifying information using the control device 4 is sorted for every game and recorded in the recording device 6 for example after the end of the final game.

A start button 21 is provided on the dealer side of the top surface of the card game table 17. As the start button 21 is pressed, the system is reset and operation is started.

The notifying lamps 5 are notifying means for notifying the inconsistent result of comparison between the two pieces of information determined with the control device 4. As shown in FIGS. 1 and 2, the notifying lamps 5 are provided in two positions, one on the card game table 17 side and the other on the monitoring station side. The notifying lamp 5 on the card game table 17 side is connected directly to the control device 4. This notifying lamp 5 is located on the dealer side on the side face of the card game table 17. This notifying lamp 5 emits light to notify the dealer of inconsistency in the result of comparing the two pieces of identifying information. The notifying lamp 5 on the monitoring station side is connected to a computer 23 on the monitoring station side connected through an interface circuit 22 to notify the monitoring staff of inconsistency between the above-mentioned two pieces of information.

A retrieved card receiving box 25 is provided on the side face on the dealer side of the card game table 17. The retrieved card receiving box 25 is a box for temporarily storing retrieved cards. The card inlet 26 of the retrieved card receiving box 25 is provided with an invalidating device 27. The invalidating device 27 is an invalidating means for invalidating, when retrieving cards, the information recorded on the identifying information recording device 2. The invalidating device 27 is provided with the identifying information reading device 3 to read identifying information of the cards 7 put in through the card inlet 26. The control device 4 records the identifying information read with the invalidating device 27 as identifying information of used cards and, in the case the identifying information of used cards is read at the start or in the middle of a game, issues a notice to that effect.

To reuse the retrieved cards, the cards are put one over another in random order with a shuffling device, and the group of the cards are put into the card distributor 15. The identifying information of these cards are deleted from the identifying information of used cards recorded in the control device 4.

When the retrieved cards are to be discard as they are without reusing, they are cut after rewriting the information recorded in the IC chips 9 of the cards 7.

As shown in FIG. 2, the control device 4 is also provided with the display device 29. The display device 29 is placed, with its display screen directed to the dealer, on the card game table 17 or the like. The identifying information reading devices 3F to 3H, the control device 4, and the display device 29 constitute an automatic input device. The identifying information reading devices 3F to 3H in the stake areas 19 read the amounts of chips. The amounts of chips read are automatically calculated with the control device 4 and displayed on the display device 29. Win or loss is judged from the card information read with the respective identifying information reading devices 3B to 3E in the card distribution areas 18, and the amounts of chips and the like are calculated and displayed.

The recording device 6 is a recording means for recording the identifying information read with the identifying information reading device 3 and the results of monitoring with the control device 4. The recording device 6 is constituted with recording means such as a hard disk or the like. Information such as monitored results, etc. obtained with the control device 4 are recorded in the recording device 6. Specifically, such information is sorted and recorded to form a database by sorting for every game for example after the end of each game or the final game.

The card game monitoring system 1 constituted as described above works as follows. The working actions are described in reference to the flowchart shown in FIG. 4.

First, whether or not the start button 21 has been pushed is determined (step S1). If the start button 21 has not been pushed, the process is finished. If the start button 21 has been pushed, the information recorded in the recording area of the control device 4 is erased by resetting the control device 4 (step S2). Next, whether or not the identifying information reading device 3A at the card takeout slot 16 has detected the identifying information of the card 7 is determined (step S3). In the case the identifying information has been detected, the identifying information is recorded in the recording area of the control device 4 (step S4). In the case the identifying information has not been detected, the process goes on to the step S5.

In the step S5, whether or not the identifying information reading devices 3B to 3E in the respective card distribution areas 18 have detected the identifying information of the cards 7. If the identifying information is detected, the identifying information is recorded in the recording area of the control device 4 (step S6). If the identifying information is not detected, the process goes on to the step S7.

In the step S7, pieces of information recorded in the recording areas of the control device 4 are mutually compared (the identifying information read with the identifying information reading device 3A of the card takeout slot 16 is compared with the identifying information read with the identifying information reading devices 3B to 3E of the respective card distribution areas 18). If this comparison proves that the identifying information at the card takeout slot 16 agrees with the identifying information at the respective card distribution areas 18, the process is finished.

In the case inconsistency is present between the pieces of information, the notifying lamps 5 light up as notification. The notifying lamp 5 provided on the card game table 17 notifies the dealer while the notifying lamp 5 connected to the computer 23 on the monitoring station side notifies the monitoring staff members (step S8).

Conceivable situations of inconsistency in the identifying information are as follows: (1) The cards 7 taken out of the card distributor 15 are not distributed anywhere. (2) The cards 7 taken out of the card distributor 15 are different from the cards 7 actually distributed in the card distribution areas 18. (3) Cards 7 that are not taken out of the card distributor 15 are distributed in the card distribution areas 18.

These situations occur when the cards 7 taken out of the card distributor 15 are removed from the game site either intentionally or by mistake, replaced with other cards 7, or improper cards are brought in from outside the game site.

Therefore, in the case the notifying lamps 5 light up, the dealer and the monitoring staff take measures against such situations.

In the case cards 7 are retrieved after the end of a game, the cards 7 are thrown into the retrieved card receiving box 25. Specifically, the cards 7 are thrown into the card inlet 26. In this way, the identifying information recorded in the identifying information recording device 2 of each of the cards 7 is destroyed as the cards 7 pass through the invalidating device 27.

During a game, the amounts of chips placed in the stake areas 19 are automatically read with the identifying information reading devices 3F to 3H, automatically calculated with the control device 4, and displayed on the display device 29 as appropriate.

At the end of each game or the final game, the identifying information read with the identifying information reading device 3 and the information on the results of monitoring with the control device 4 are recorded in the recording device 6. In the recording device 6, information on the results of monitoring or the like is sorted for respective games, accumulated, and arranged as a database. The data accumulated in the recording device 6 may be checked as required appropriately.

As described above, any anomaly in the state of distribution of the cards 7 is automatically detected and notified to the dealer and the monitoring staff members. Therefore, the number of staff members may be made to a minimum and so a drastic reduction in the running cost is possible.

Since the identifying information of the retrieved cards 7 is destroyed with the invalidating device 27, inadvertent use of the retrieved cards 7 is prevented. As a result, cards are prevented from mixing in over the entire period of a game from its start to the retrieval of cards after the end of the game.

In the case cards are to be discarded, the information recorded in the IC chips 9 of the cards 7 is rewritten and then the cards 7 are processed by cutting or the like. Therefore, it is impossible to take out IC chips 9 from the discarded cards and fit them in other cards for fraudulent use, or to make fake cards using data read from the IC chips 9.

And, since the amounts of chips are automatically calculated and displayed on the display device 29, calculation error by the dealer is prevented from occurring.

Incidentally, while the above embodiment is arranged with the individual identifying information reading devices 3B to 3H for reading the identifying information of the cards 7 and chips being used in a game are provided in the card distribution areas 18 and the stake areas 19, they may be provided in other areas as required. For example, in the case it is possible to place the cards 7 or the like in other areas than the distribution areas 18 or the like, the individual identifying information reading devices may be provided over the entire card game table 17.

In the above embodiment, the notifying lamps 5 are used as the notifying means. However, the notifying means is not limited to light but may be other means, such as sound by a buzzer or vibration by a vibrator.

In the above embodiment, the information recorded on the IC chip 9 of the card 7 is rewritten before discarding the card 7. However, the identifying information may also be destroyed by applying strong magnetic field or by causing high voltage discharge.

The above embodiment is described as an example in which the card game monitoring system 1 is embedded in the card game table 17. However, the system may also be used with any other playing table than the card game table.

The present invention as described in detail above provides effects as described below.

Anomaly in the situation of card distribution, if any, may be reliably detected because cards recognized at the start of a game are compared with cards recognized during the game using a system comprising: a wirelessly communicable, identifying information recording means embedded in a card for recording at least information for identifying a self; an identifying information reading means, provided in a part in contact with the card at least at the start and in the middle of a game, for reading by wireless communication the information recorded in the identifying information recording means; and a control means for monitoring consistency between the identifying information read with the identifying information reading means at the start of the game and the identifying information read with the identifying information reading means in the middle of the game by comparing both pieces of the identifying information; to compare the cards recognized at the start of the gage with cards recognized in the middle of the game.

Cards brought into a game may be detected with an identifying information reading device provided at the card takeout slot of the card distributor. Cards actually in use in the game may be detected with the identifying information reading device provided in the card distribution area of the table. Loss or replacement of cards may be reliably detected by comparing both of the above detection results.

Since the notifying means is provided to issue a notice of inconsistency between the two pieces of information compared using the control device, the dealer and/or the monitoring staff can easily learn the loss or replacement of cards.

Since the invalidating means is provided to invalidate the information recorded in the identifying information recording device of retrieved cards, the retrieved cards are prevented from being brought into the game site by mistake or by intention.

As described above, it is possible to reduce the number of monitoring staff members to a minimum and to drastically reduce the running cost.

Since the recording means is provided to record the results of comparing identifying information and/or the game results, etc. are arranged as a database, wrong acts can be found retroactively by reviewing them. In other words, in the case any doubt about a specific game on a specific day arises at a later date, wrong acts, if any, can be found retroactively by reviewing the data of the game results or the like of that day.

What is claimed is:

1. A card game monitoring system comprising:

a wirelessly communicating identifying information recording means embedded in a card for recording at least information for identifying itself;

identifying information reading means, located in a part in contact with the card at least at a start and in a middle of a game, for reading by wireless communication, using a magnetic field, the information recorded on the identifying information recording means;

control means for monitoring consistency between the identifying information read with the identifying information reading means at the start of the game and the identifying information read with the identifying information reading means in the middle of the game, by comparing the identifying information at the start of the game with the identifying information in the middle of the game; and a retrieved card receiving box for temporarily storing retrieved cards, the retrieved card receiving box including invalidating means for invalidating the information recorded on the identifying information recording means when the card is retrieved, wherein the part of the system where the identifying information reading means is located and with which the card comes into contact at the start of the game is a card takeout slot of a card distributor, and the part of the system where the identifying information reading means is located and with which the card comes into contact in the middle of the game is a card distribution area of a table.

2. The card game monitoring system according to claim 1, further comprising notifying means for notifying of an inconsistency, if any between the identifying information at the start of the game with the identifying information in the middle of the game as a result of the comparing by the control means.

3. A card game table for playing games while distributing and putting in order cards, wherein the card game monitoring system according to claim 2 is incorporated in the card game table.

4. The card game monitoring system according to claim 1, further comprising recording means for recording the identifying information read with the identifying information reading means and results of monitoring with the control means.

5. A card game table for playing games while distributing and putting in order cards, wherein the card game monitoring system according to claim 4 is incorporated in the card game table.

6. A card game table for playing games while distributing and putting in order cards, wherein the card game monitoring system according to claim 1 is incorporated in the card game table.

7. A card game monitoring method comprising:

reading information recorded on a card used for a game, wirelessly, using a magnetic field, at a start of the game, when the card is taken out from a card distributor, the information identifying the card;

reading information recorded on a card used for the game, wirelessly, using a magnetic field, in a middle of the game, when the card is distributed on a card game table, the information identifying the card;

comparing the information read at the start of the game and the information read in the middle of the game for monitoring consistency between the information read, using a controller;

retrieving the card in a card receiving box and temporarily storing the card retrieved; and invalidating the information recorded on the card when the card is retrieved.

8. The card game monitoring method according to claim 7, further comprising recording the information read at the start of the game or in the middle of the game and results of the monitoring.

9. The card game monitoring method according to claim 8, further comprising reviewing the information recorded to find wrongful acts retroactively.

* * * * *